United States Patent [19]

Massa

[11] 4,348,869

[45] Sep. 14, 1982

[54] MEANS FOR DETECTING THE ACCUMULATION OF FROST IN A LOW TEMPERATURE REFRIGERATION SYSTEM

[75] Inventor: Frank Massa, Cohasset, Mass.

[73] Assignee: The Stoneleigh Trust, Cohasset, Mass. ; Fred M. Dellorfano, Jr. and Donald P. Massa, Trustees

[21] Appl. No.: 183,231

[22] Filed: Sep. 2, 1980

[51] Int. Cl.[3] ..... F25D 21/02

[52] U.S. Cl. ..... 62/140; 62/234

[58] Field of Search ..... 62/140, 234, 151, 155, 62/156

[56] References Cited

U.S. PATENT DOCUMENTS 4,176,524 12/1979 Kamiyama et al. ..... 62/140

4,206,612 6/1980 Gardner ..... 62/234

FOREIGN PATENT DOCUMENTS 54-35449 3/1979 Japan ..... 62/140

*Primary Examiner*—Albert J. Makay

*Assistant Examiner*—Harry Tanner

[57] ABSTRACT

The resonant frequency of an electroacoustic transducer controls the frequency of an oscillating circuit while the transducer vibratile element remains unobstructed. An extended small area portion of the vibratile element is mounted at a fixed distance from the subfreezing surface of a freezer compartment on which a specified layer of frost is to be detected. When the frost layer builds up to the specified thickness it makes contact with the extended vibratile tip portion of the vibratile element and inhibits the vibration of the vibratile element thus causing the oscillator circuit to stop oscillating. The detected change in the circuit condition is used to initiate the defrost cycle.

4 Claims, 3 Drawing Figures

MEANS FOR DETECTING THE ACCUMULATION OF FROST IN A LOW TEMPERATURE REFRIGERATION SYSTEM

This invention is concerned with an improved means for the detection and automatic removal of accumulated frost on the sub-freezing surfaces of a refrigerator compartment such as, for example, occurs in the freezer section of home refrigerators. Automatic defrost systems in common use in freezer sections of home refrigerators as well as in chest type freezers generally employ electric heater elements which are turned on to preset periodic intervals to melt any accumulated frost that may develop between the defrosting intervals.

Conventional automatic defrost systems in common use have inherent disadvantages that result from the fact that the defrost cycles are initiated at specific time intervals instead of being initiated by the accumulation of a specified thickness layer of frost. As a result, during periods when the frost accumulation is low, the automatic periodic defrost heating cycles introduce excessive unnecessary heating in the freezer compartment which results in a waste of electrical energy and also causes accelerated deterioration of the stored frozen foods. For example, it is common knowledge that in conventional automatic defrost refrigerators, the consistancy of stored ice cream will range from very hard to extra soft depending on the amount of unnecessary heating generated during the defrost cycles. In order to overcome the disadvantages of the conventional automatic defrost systems, this invention provides an improved frost detection and frost removal system in which the defrost cycle is activated by the presence of a measured accumulated layer of frost of a specified thickness on a sub-freezing temperature surface of the refrigerating system.

Previous attempts to automatically detect frost in a refrigerator have attempted to use the change in resonant frequency of an electroacoustic transducer caused by the accumulated frost on the surface of the vibratile diaphragm which is exposed to the sub-freezing low temperature portion of the freezer compartment. A typical example of such a system is disclosed in U.S. Pat. No. 4,176,524. The patent shows a transducer with an exposed vibratile diaphragm which is operated at resonance by a piezoelectric ceramic disc bonded to the inner surface of the diaphragm in the conventional manner. The base of the transducer is attached to the freezer portion of the refrigeration system so that the exposed diaphragm surface is cooled to sub-freezing temperature and as a result frost develops on the diaphragm surface. When frost accumulates on the transducer diaphragm, the resonance frequency is changed and the measured change in frequency is used to initiate the defrost cycle. The disadvantage of this prior art frost detection system is that the resonant frequency of the transducer is dependent on other environmental conditions and therefore a change in resonant frequency may occur from conditions other than the accumulation of frost on the surface of the diaphragm. One of these conditions is the presence of water on the diaphragm surface that accumulates during the defrost cycle and thus causes a malfunction by continuing the defrost cycle after the frost has been thawed. In fact this serious difficulty is mentioned in U.S. Pat. No. 4,176,524 in the paragraph beginning on line 33, column 4, and a solution to the problem of spurious operation due to the presence of water on the diaphragm is described in connection with FIG. 6 of the patent in which a heating element 42 is potted into the base of the transducer and the heater is energized during or after the defrost cycle so that—"By such heating with the heater 42, the frost detector becomes completely dried before the next starting of freezing or cooling, and therefore, no spurious signal due to remaining water is produced." (Col. 4, lines 49–53).

This invention overcomes the limitations and disadvantages of prior art frost detectors by directly measuring the thickness of the actual frost layer which has accumulated on the sub-freezing surface of the refrigeration system. The invention makes use of electroacoustic or electromechanical transducers in combination with low cost circuits to act as sensors to recognize the presence of a specified thickness layer of accumulated frost on the sub-freezing temperature surface of the refrigerating system. Upon the recognition of the specified thickness layer of accumulated frost, the inventive system will initiate a command signal to start the defrost cycle. With this improved inventive system, the defrost cycle will only be initiated when the specified layer of frost is actually formed on a surface of the freezer compartment. Therefore, under ambient conditions when frost builds up very slowly, or in some instances when frost does not form, the inventive defrost system remains inactive, thus saving electric power and also prevents the unnecessary overheating of the freezer compartment, and thereby maintains the contents of the freezer at a more constant lower average temperature, thus preserving the quality of the frozen foods for longer periods.

The primary object of this invention is to provide improved means for automatic defrosting in a refrigerating system, whereby the defrost cycle is initiated by the presence of an accumulated layer of frost of a specified thickness on the sub-freezing temperature surface of the refrigerating system.

Another object of this invention is to use an ultrasonic echo-ranging sensor for detecting the thickness of the accumulated frost layer.

A further object of this invention is to employ an electromechanical transducer as a frost detector and whose free unobstructed vibratile element is placed at a fixed specified distance from the freezer surface on which the specified thickness layer of frost is to be detected. The vibratile element is used to control the frequency of an oscillating circuit while the vibratile element remains unobstructed. When the frost layer builds up to a specified thickness and makes contact with the vibratile surface of the transducer to inhibit its vibration, the circuit stops oscillating and this change in circuit condition is used to start the defrost cycle.

A still further object of this invention is to use a plurality of sensors for detecting the thickness layer of frost as it accumulates on different surfaces of separated freezer compartments such as are employed in the frozen food section of supermarkets. The plurality of sensors are connected to a common electronic signal processing circuit which sequentially samples the signal from each sensor and automatically activates the specific defroster associated with each sensor that indicates the presence of the specified layer of frost build-up that requires the initiation of the defrost cycle.

Other objects of the invention will become evident in the following detailed description. The novel features which are characteristic of the invention are set forth with particularity in the appended claims. The invention itself, however, both as to its organization and method operation, as well as advantages thereof, will best be understood from the following description of several embodiments thereof when read in connection with the accompanying drawings, in which:

Figure 1:
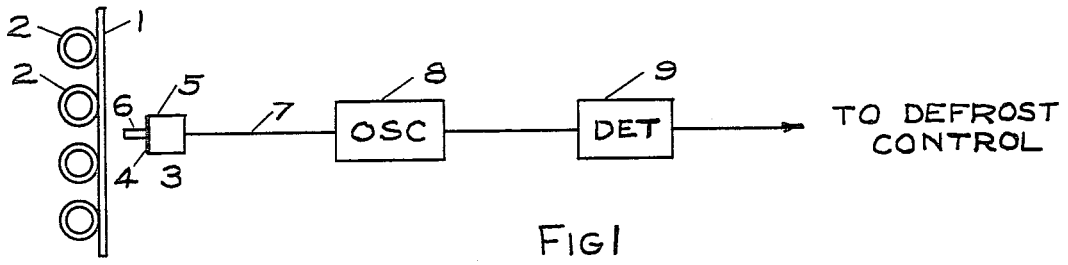
FIG. 1 is a schematic illustration of one preferred embodiment of my invention.

Referring more specifically to the figures, the reference character 1 illustrates an edge view of the refrigerated wall surface of a freezer compartment whose temperature is maintained below the freezing point of water. The cold temperature is maintained by circulating a refrigerant through the tubes 2, which are soldered or welded to the surface of the wall plate 1 as is well known in the art. An electroacoustic transducer 3 which includes a thin vibratile diaphragm 4 cemented to the periphery of the housing 5, is driven by a thin piezoelectric ceramic disc cemented to the center of the inner surface of the diaphragm (not shown in the view of the transducer) in the well known manner familiar to anyone skilled in the art. More detailed information on various well known structures which may be used in the construction of transducer 3 may be found in U.S. Pat. Nos. 3,128,532, 3,578,995 and 3,638,052. Cemented to the center of the vibratile diaphragm 4 is a small diameter lightweight probe 6 as illustrated in FIG. 1. The transducer 3 is mounted by a bracket or any other suitable means, not shown, so that the free end of the probe 6 is spaced from the refrigerated wall surface 1 by an amount equal to the layer thickness of accumulated frost which is to be detected. The electrical connection from the transducer to the oscillator circuit 8 is made by the cable 7. The resonance frequency of the oscillator circuit 8 is established by the free resonant frequency of the transducer as is well known in the art of frequency controlled circuits. While the oscillator signal is present, the detector 9 recognizes the oscillator frequency and no activation signal is sent to the defroster control circuit. When the layer of frost on surface 1 builds up to the specified thickness sufficient to make contact with the tip of the probe 6, the diaphragm will be prevented from vibrating and the oscillator 8 will stop oscillating. The absence of oscillation will be sensed by the detector 9, at which time it will send an activate signal to the defrost control circuit and automatically initiate the defrosting cycle. The specific circuit details for accomplishing the various electrical functions described are not shown because they are well known to any electronic engineer skilled in the art and the specific circuits are not part of this invention. The invention is in the novel system as described herein for automatically initiating the defrost cycle in a refrigerating system when the frost on a sub-freezing surface of the freezer unit has accumulated to a specified thickness. The frost layer thickness, when it accumulates to a specified thickness is detected by the inventive system, which in turn activates the defrost cycle. The use of the probe 6 attached to the center of the diaphragm, which is the point of maximum diaphragm displacement during its free resonant vibration while the transducer is controlling the frequency of the oscillator 8, gives increased assurance that the transducer diaphragm 4 will be prevented from continued vibration when the frost layer accumulated on the wall surface 1 reaches the tip of the probe 6.

The piezoelectric transducer 3 as described is one of many different transducer types that may be used in this invention. Other well known electromechanical and electroacoustic transducers operating on different transduction principles including electromagnetic, magnetostriction, crystal, and electrostatic as described in an article by Frank Massa entitled "Ultrasonic Transducers for Use in Air", published in the Proceedings of the Institute of Electrical and Electronics Engineers, Vol. 53, Oct. 1965, page 1363, can be used in this invention as the sensor element.

Figure 2:
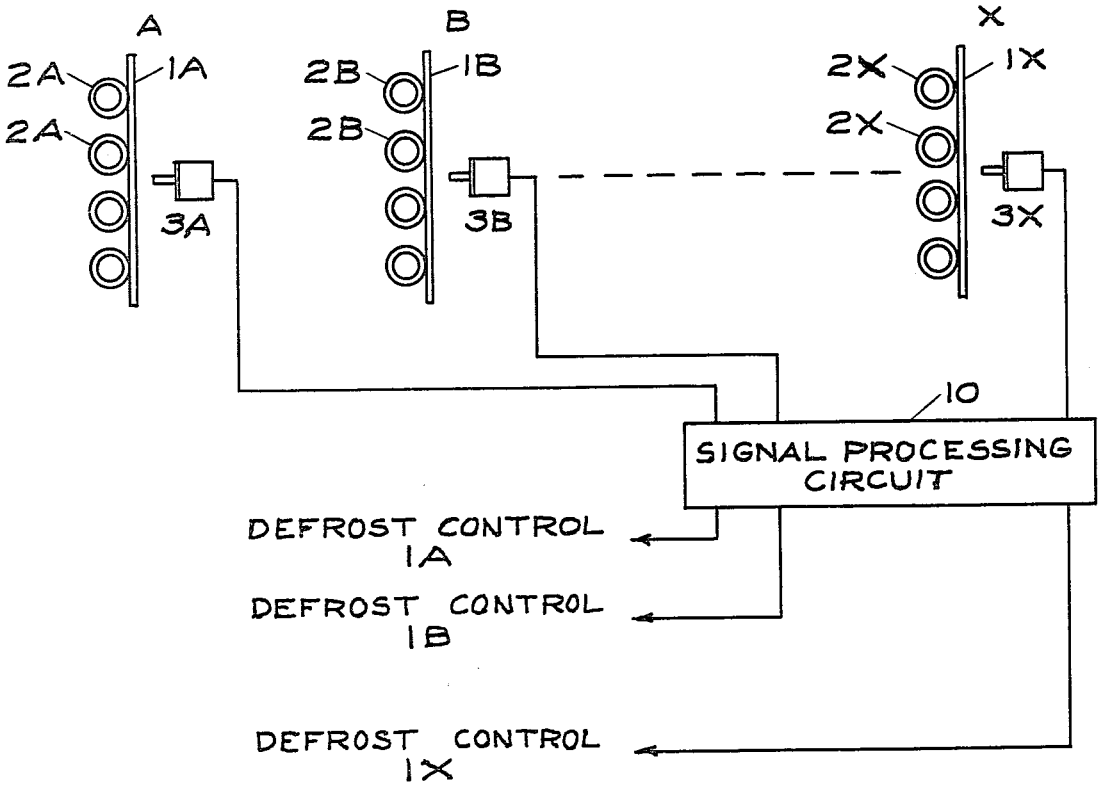
FIG. 2 is a schematic illustration of another embodiment of the invention illustrated in FIG. 1 for use in a multi-compartment freezer unit.

FIG. 2 illustrates the use of the frost detection system illustrated in FIG. 1 as applied to commercial freezers having a plurality of separated freezer sections such as are used in the frozen food section of supermarkets. Referring to FIG. 2, the separated freezer sections are indicated by A, B,—X. Each section has a refrigerated wall surface 1A, 1B,—1X with the attached cooling coils 2A, 2B,—2X. A transducer 3A, 3B,—3X is installed in each respective freezer compartment in the same manner described for the transducer 3 in FIG. 1. Electrical connection from each transducer is made to a central signal processing circuit 10 which sequentially connects each of the transducers 1A,1B,—1X to an oscillator and detector circuit contained in the signal processor which is similar to the circuit illustrated in FIG. 1. If any of the extended vibratile probe tips of the transducers have been blocked by the accumulation of a layer of frost of sufficient thickness to reach the tip of the probe which projects from the center of the diaphragm surface, the blocked transducer will not be oscillating when it is sequentially checked by the signal processing circuit 10. When such a condition is detected by the signal processing circuit, a command signal will be transmitted by the signal processing circuit to initiate the defrost cycle in the particular freezer section which contains the blocked transducer. The use of a common signal processing circuit 10 to sequentially examine the state of the transducer controlled oscillator frequencies for a plurality of separated freezer compartments will reduce the cost of the frost detection equipment for use with such freezer systems.

Figure 3:
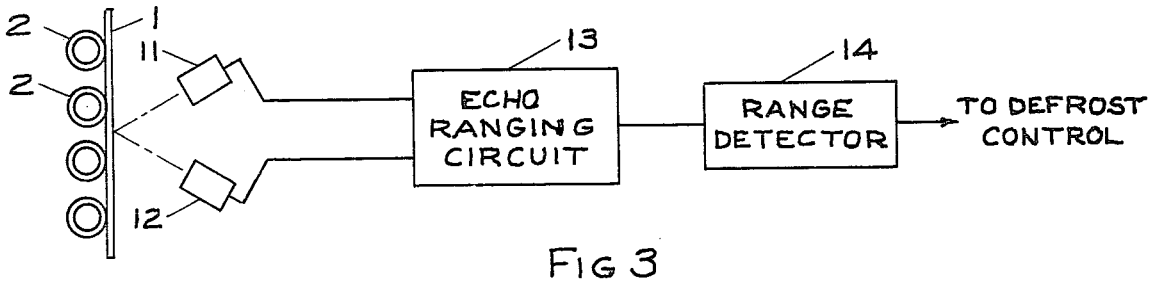
FIG. 3 is a schematic illustration of another embodiment of my invention for detecting the presence of a layer of frost of specified thickness on the sub-freezing temperature surface of a freezer compartment.

The described use of an electroacoustic transducer as a frequency control element in an oscillator circuit for detecting the frost layer thickness is one of several frost detection means which this invention can utilize. Another means for directly measuring the thickness of an accumulated layer of frost is illustrated in FIG. 3. A pair of high frequency ultrasonic transducers 11 and 12 are mounted as illustrated in fixed spaced relationship to the sub-freezing wall surface 1 by any suitable mounting structure (not shown). The transducer 11 acts as a transmitter and transducer 12 acts as a receiver. The transducers are connected to a conventional echo-ranging circuit 13 which measures the time for a high frequency ultrasonic tone burst to travel from the transmitter 11 to the wall 1 and back to the receiver 12. The measured transit time for the reflected echo to be received represents the distance from the wall to the transducers. As the frost layer accumulates on the surface of the wall 1, the transit time will be shortened. When the measured transit time is shortened to a value corresponding to a specified thickness of the accumulated frost layer, the range detector circuit 14 will initiate a command signal to activate the defroster. The choice of ultrasonic frequency should preferably be such that the wavelength of the transmitted acoustic signal is small compared to the thickness of the layer of frost that is to be detected. For example, if a frost thickness layer of 0.1" is the specified amount to be detected, a wavelength of 0.02", which is 10% of the round-trip distance of 0.2", would be generally satisfactory for an acceptable precision of measurement. If higher precision is desired, the frequency may be increased. The operating frequency ultrasonic corresponding to a wavelength of 0.02" is approximately 650 kHz.

While a few specific embodiments of the present invention have been shown and described, it should be understood that various additional modifications and alternative constructions may be made without departing from the true spirit and scope of the invention. Therefore, the appended claims are intended to cover all such equivalent alternative constructions that fall within their true spirit and scope.

I claim:

1. Means for detecting the accumulation of a layer of frost of a specified thickness on a sub-freezing surface of a refrigeration system, said detection means includes an electroacoustic transducer, said transducer characterized in that it includes a vibratile element that can be operated at a resonant frequency mode, mounting means for holding said electroacoustic transducer with its vibratile element in close proximity to the sub-freezing surface on which the layer of frost is to be detected, an oscillator circuit, said oscillator circuit characterized in that its frequency of oscillation is controlled by the resonant frequency of said vibratile element, said vibratile element further characterized in that a vibrating portion of said vibratile element includes a projecting probe-like tip portion which is located at a fixed distance from said sub-freezing surface, said fixed distance is determined by the specified thickness layer of accumulated frost which is to be detected, said oscillator circuit further characterized in that the circuit stops oscillating when the frost layer accumulates to a thickness sufficient to reach said projecting probe-like tip portion of said vibratile element and prevents the continued resonant frequency mode of vibration of said vibratile element, detection circuit means connected to the output of said oscillator circuit for detecting the presence of said oscillator signal, said detection circuit means characterized in that the stopping of the oscillation of said oscillator circuit is recognized by said detector, the recognition by said detector of said change in state of said oscillator circuit output signal indicates that the frost layer thickness has accumulated to said specified thickness.

2. The invention in claim 1 and a defroster element associated with said refrigeration system, activating means for operating said defroster element, said activating means characterized in that it is responsive to said change in state of said oscillator circuit when said layer of frost has accumulated to said specified thickness.

3. The invention in claim 1 characterized in that said refrigerating system comprises a plurality of separate freezer compartments, and further characterized in that said detection means includes a plurality of electroacoustic transducers which are mounted in close proximity to a plurality of sub-freezing surfaces representative of the plurality of the separate freezer compartments on which surfaces the accumulated frost layer thicknesses are to be detected, a central data processing circuit including an oscillator, separate electrical connections from each of said plurality of transducers to said central data processing circuit, said data processing circuit characterized in that electrical connection means are provided for sequentially connecting each of said plurality of transducers to the oscillator circuit, detection means for detecting the presence or absence of oscillation in said oscillator circuit as each transducer is sequentially connected to said oscillator circuit, a separate defroster element associated with each separate freezer compartment, activating means for operating said separate defroster elements, said activating means characterized in that it is responsive to said change in state of said oscillator circuit when a layer of frost of specified thickness has accumulated on any particular freezer compartment wall sufficient to inhibit the resonant vibration of the transducer mounted close to said particular wall, whereby said particular defroster associated with said particular freezer compartment is activated.

4. The invention in claim 3 further characterized in that said vibrating portion of each of said plurality of vibratile transducer elements includes a small projecting tip portion from said vibratile transducer element, and further characterized in that the free end of said projecting tip portion is located at said fixed distance from said sub-freezing surface.

* * * * *